United States Patent [19]

Sowash

[11] 4,395,609

[45] Jul. 26, 1983

[54] CAM OPERATED DUAL SWITCH ASSEMBLY

[75] Inventor: Thomas R. Sowash, Anderson, Ind.

[73] Assignee: General Motors Corporation, Detroit, Mich.

[21] Appl. No.: 286,454

[22] Filed: Jul. 24, 1981

[51] Int. Cl.[3] ..... H01H 13/66

[52] U.S. Cl. ..... 200/153 LA; 200/6 B; 200/16 R; 200/153 V

[58] Field of Search ..... 200/153 L, 153 LA, 153 V, 200/6 B, 6 BB, 6 BA, 16 R; 74/567

[56] References Cited

U.S. PATENT DOCUMENTS

| | | | |
|---|---|---|---|
| 2,763,739 | 9/1956 | Forstrom et al. | 200/6 BB |
| 3,060,285 | 10/1962 | Steinbruner | 200/159 A |
| 3,238,797 | 3/1966 | Coughren | 200/153 L |
| 3,258,549 | 6/1966 | Stoi | 200/153 V |
| 3,407,278 | 10/1968 | Stoi | 200/153 V |
| 3,467,800 | 9/1969 | Barr | 200/153 V |
| 3,586,805 | 6/1971 | Ziegler | 200/153 L |
| 3,906,178 | 9/1975 | Fiddler et al. | 200/153 LA |

FOREIGN PATENT DOCUMENTS

| | | | |
|---|---|---|---|
| 587763 | 5/1947 | United Kingdom | 200/153 LA |

*Primary Examiner*—John W. Shepperd
*Attorney, Agent, or Firm*—Warren D. Hill

[57] ABSTRACT

A linear motion switch assembly suitable for a set switch of a vehicle automatic speed control contains two cam operated switches which are actuated in a specific sequence, i.e. the first switch and then the second switch is actuated upon the movement of the actuator in one direction and then the first switch and then the second switch is actuated during the opposite direction of movement of the actuator. To accomplish this, a cam fixed on the actuator operates one of the switches but a second cam connected to the actuator by a lost motion connection operates the second switch. The actuator is a reciprocating element guided along a guideway molded in the switch housing and the switch elements comprise a leaf spring fixed at one end to a circuit board and the other end free to move toward or from a stationary contact also on the circuit board.

4 Claims, 4 Drawing Figures

CAM OPERATED DUAL SWITCH ASSEMBLY

This invention relates to a cam operated dual switch assembly and particularly to such an assembly which provides an alternating sequence of switch actuation upon actuator reciprocation.

It is desirable, for example in certain types of vehicle speed control systems, to operate a pair of switches by a single push button and to actuate the switches in a certain order when the button is pushed in and to again actuate the switches in the same order when the button is released. In rotary switches or switches having a rotary actuator, such a repetitive pattern in a switching sequence is readily attained. However, with the simple reciprocating push button switch having a linear actuator, the normal switching sequence upon release of the push button is the opposite of that during depression of the push button. In such vehicle switches, it is desirable to maintain simplicity and low cost construction along with reliability.

It is, therefore, an object of this invention to provide a simple switch with a reciprocating actuator capable of operating two switches in a certain sequence during one direction of movement of the actuator and repeating the same sequence of switch operation during the return movement of the actuator.

The invention is carried out by providing a pair of switches operated by cams carried on a reciprocating actuator, one of the cams being fixed to the actuator for movement therewith and the other cam being mounted on the actuator through a lost motion connection to allow the fixed cam to actuate its respective switch prior to the second cam operating its switch regardless of the direction of movement of the actuator.

The above and other advantages will be made more apparent from the following specification taken in conjunction with the accompanying drawings wherein like reference numerals refer to like parts and wherein.

Figure 1:
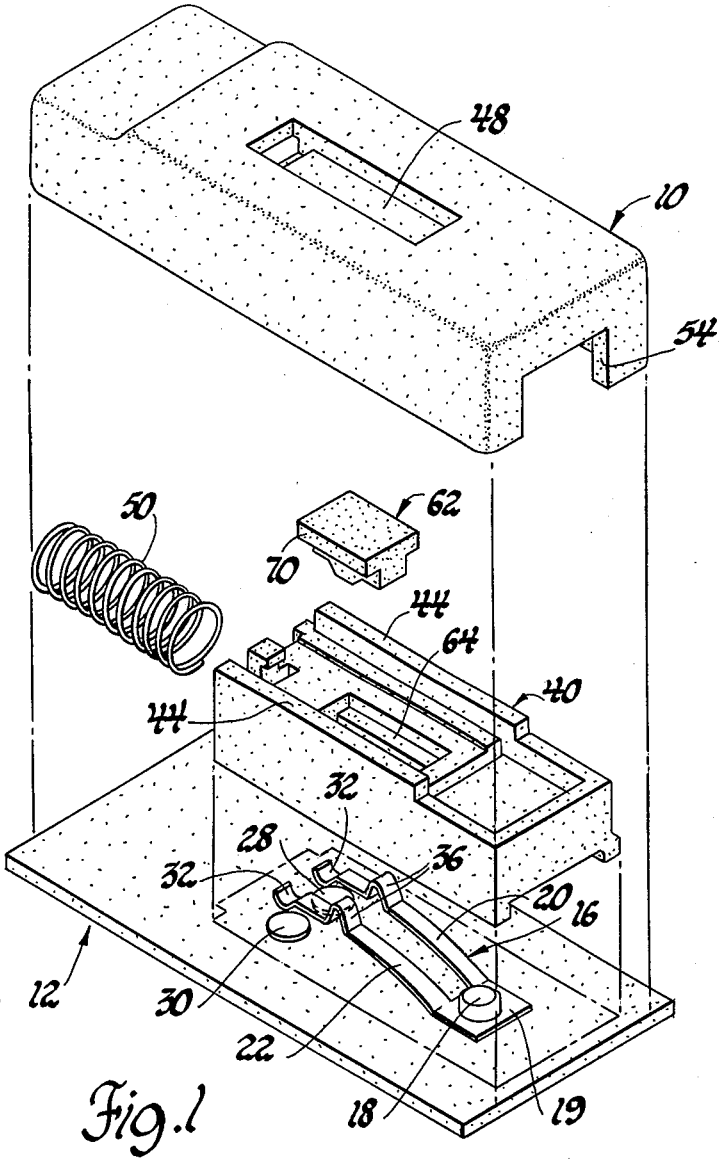
FIG. 1 is an exploded view of a switch assembly according to the invention.

For purposes of this description, the terms "switch actuation", "switch operation" and "state of change of a switch" refer to the opening of a switch, the closing of a switch or even a momentary opening or closing of a switch to provide a pulse output when connected in a suitable circuit.

Referring to the drawings, the switch assembly includes a molded plastic housing 10 open at one side, a printed circuit board 12 covering that open side thereby forming a switch cavity 14, a generally U-shaped contact element 16 made of spring material, such as tinned bronze, secured by a rivet 18 to the circuit board 12 and having a base 19, and two spring arms 20 and 22 bent upwardly at an angle to the board. A pair of stationary contacts 28 and 30 mounted on the circuit board 12 are positioned for cooperation with the free ends of the arms 20 and 22 thereby forming two switches. Circuitry, not shown, on the circuit board 12 is connected to each of the contacts 28 and 30 and the contact element 16. The free end of each arm 20 and 22 is formed in a rounded concave cup portion 32 for engaging the contacts 28 and 30. A convex cam follower 36 is formed in each arm 20 and 22 part way between the base 19 of the contact element 16 and the cup portion 32.

Figure 2:
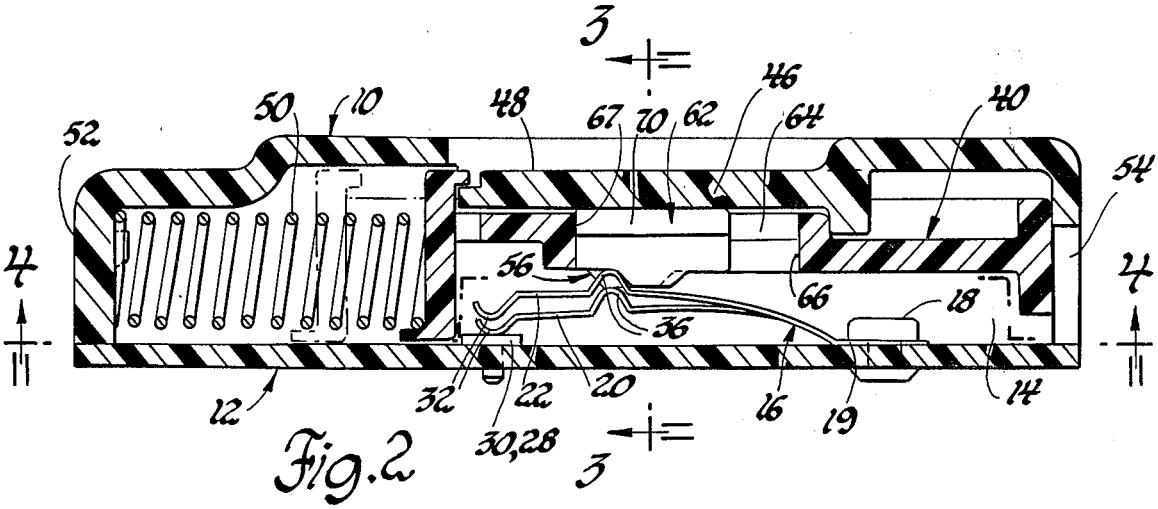
FIG. 2 is a cross sectional view of a switch assembly of FIG. 1.
Figure 3:
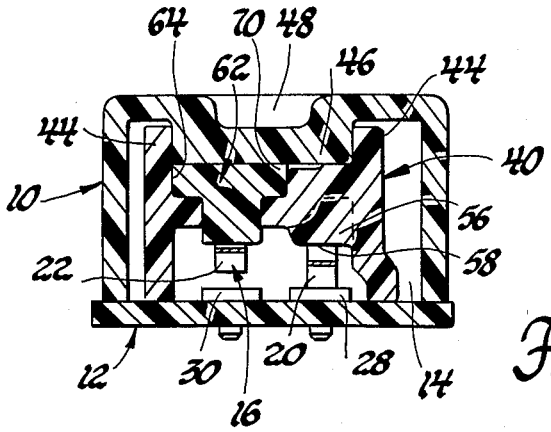
FIG. 3 is a cross sectional view taken along line 3—3 of FIG. 2.
Figure 4:
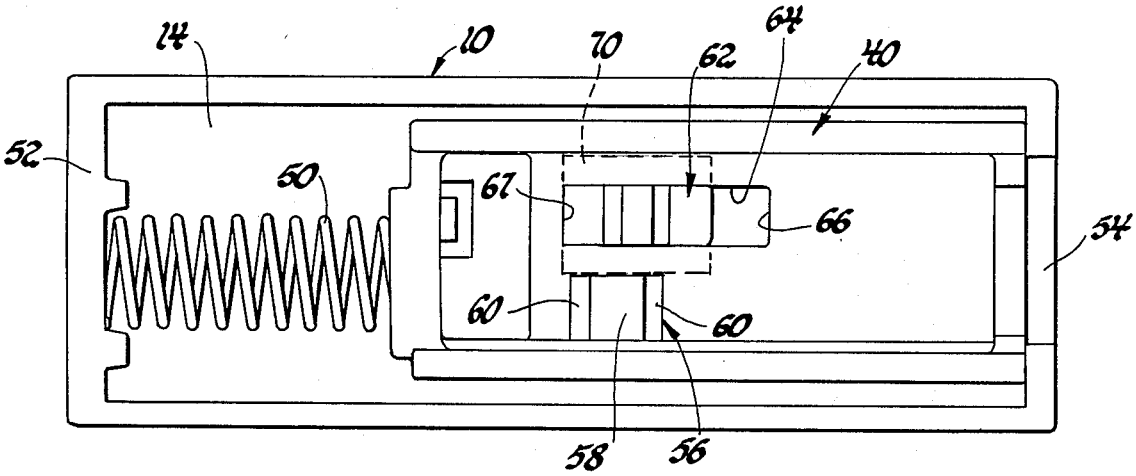
FIG. 4 is a view of the actuator of the switch assembly according to the invention taken along line 4—4 of FIG. 2.

A reciprocating actuator 40 is a generally box-like structure having a cavity in its lower surface straddling the contact structure on the circuit board. The upper surface of the actuator 40 has raised ridges 44 along each side which cooperate with a boss 46 formed in the inner top surface of the housing 10, the boss serving as a guideway for the actuator 40 for limiting the movement of the actuator 40 within the switch cavity to linear reciprocation. The formation of the boss 46 in the molded housing 10 results in a complementary depression 48 in the outer housing surface. A coil spring 50 compressed between the actuator 40 and an end wall 52 of the housing biases the actuator toward the extreme right side of the housing as seen in FIGS. 1 and 2. An opening 54 in the right wall of the housing 10 permits entry of some element, not shown, for moving the actuator 40 to the left against the action of the spring 50. The actuator 40 carries two cams for coaction with the spring arms 20 and 22. One cam 56 is an integrally molded portion of the actuator and is positioned on the underside of the actuator to one side for engagement of the spring arm 20. The cam contour is flat on its lower surface 58 and has two end ramps 60. The other cam 62 is in the form of a shuttle which slidably nests in a slot 64 in the actuator adjacent the cam 56 to provide a lost motion action. The ends of the slot 64 serve as limits 66 and 67 for selectively engaging the cam 62 within the slot. The lower cam surface is shaped generally like that of the cam 56 and it is positioned to coact with the spring arm 22. As seen in FIGS. 1 and 3, the movable cam 62 is generally T shaped in cross section and the slot 64 is similarly shaped so that the upper cross member 70 of the T is trapped between the actuator and the boss 46 to retain the cam 62 within the actuator slot 64.

When a cam engages the cam follower 36 on a spring arm, that arm is pressed into engagement with its corresponding stationary contact 28 or 30. When, however, a cam is out of engagement with the cam follower 36, the respective spring arm is released sufficiently to separate from its respective stationary contact thereby opening that switch. As a matter of design, the cams can be placed so that when the actuator is in the rest position, as shown in the drawings, either switch may be normally open or closed and then changed to the opposite state when the actuator is linearly moved to the left. For the illustrated embodiment, the fixed cam 56 is located to hold the spring arm 20 in normally closed position while the movable cam 62 is positioned so that the spring arm 22 is in normally open position. When the actuator is actuated, that is, moved toward the left away from its rest position, the fixed cam 56 slips off its respective cam follower 36 allowing the respective switch to open. Then with further movement, the limit 66 on the actuator pushes the movable cam 62 over the cam follower 36 on its respective spring arm 22 to close that switch. The upward bias of the leaf spring 22 against the cam 62 presses the top of the cam against the lower surface of the guideway 46 to thereby frictionally hold the cam in the switch closed position even when the actuator begins its return movement toward the rest position. During the return movement, the fixed cam 56 re-engages its respective cam follower 36 to close that switch. Due to the lost motion connection of the cam 62 to the actuator, the cam 62 does not move until the limit 67 engages the cam 62 to overcome the frictional force holding it in place and pushes the cam off its respective follower 36 so that the respective switch returns to its normally open position. That switch may be released with a snap action so that the force of the cam follower against the ramp of the cam 62 thrusts the cam toward the right end of the slot 64. Thus, during the normally open position of that switch, the cam 62 may reside anywhere in the slot.

The principle of this switch design requires switch placement relative to the cams such that the fixed cam 56 always leads the movable cam 62 in switch operation. Thus, when the actuator is moved in either direction, the switch operated by cam 56 will be actuated first and the same sequence of switch actuation will occur during movement of the actuator to the left or to the right.

It will thus be seen that the switch assembly according to this invention provides a simply constructed, inexpensive switch assembly having a unique programmed sequence of switch operation.

The embodiments of the invention in which an exclusive property or privilege is claimed are defined as follows:

1. A switch assembly having two switches alternately operated by a reciprocable actuator comprising first and second cam operated switches, each switch being actuable between open and closed states, a reciprocable actuator for sequentially changing the state of the first switch and then the state of the second switch upon movement in one direction and for sequentially changing the state of the first switch and then the state of the second switch upon movement in the return direction, and the actuator having a first cam fixed thereto for movement therewith for operating the first switch and a second cam for operating the second switch, the second cam slidably supported by the actuator between first and second limits so as to form a lost motion connection between the actuator and the second cam, the second cam being shifted relative to the second switch for switch operation by engagement with the first limit during actuator movement in one direction and being shifted again relative to the second switch for switch operation by engagement with the second limit during actuator movement in the other direction, the switches being so positioned relative to the cams that upon movement of the actuator in either direction the cams operate their respective switches in the same order.

2. A switch assembly having two switches alternately operated by a reciprocable actuator comprising a switch housing, an elongated guideway integral with the interior of the housing, first and second cam operated switches in the housing, each switch being actuable between open and closed states, a reciprocable actuator in the housing and slidably retained by the guideway for sequentially changing the state of the first switch and then the state of the second switch upon movement in one direction and for sequentially changing the state of the first switch and then the state of the second switch upon movement in the return direction, and the actuator having a first cam fixed thereto for movement therewith for operating the first switch and a second cam for operating the second switch, a slot in the actuator extending parallel to the direction of movement, the second cam slidably supported by the actuator in the slot between first and second limits defined by the slot so as to form a lost motion connection between the actuator and the second cam, the second cam being shifted relative to the second switch for switch operation by engagement with the first limit during actuator movement in one direction and being shifted again relative to the second switch for switch operation by engagement with the second limit during actuator movement in the other direction, the switches being so positioned relative to the cams that upon movement of the actuator in either direction the cams operate their respective switches in the same order.

3. A switch assembly having two switches alternately operated by a reciprocable actuator comprising a housing and a circuit board together comprising a switch cavity, first and second cam operated switches in the switch cavity, each switch being actuable between open and closed states, the switches comprising leaf spring contact means secured to the circuit board and having a free end for each switch and a stationary contact for each switch mounted on the circuit board adjacent a free end for contact thereby, a reciprocable actuator in the switch cavity for sequentially changing the state of the first switch and then the state of the second switch upon movement in one direction and for sequentially changing the state of the first switch and then the state of the second switch upon movement in the return direction, and the actuator having a first cam fixed thereto for movement therewith into engagement with the leaf spring contact means for operating the first switch and a second cam for movement into engagement with the leaf spring contact means for operating the second switch, the second cam slidably supported by the actuator between first and second limits so as to form a lost motion connection between the actuator and the second cam, the second cam being shifted relative to the second switch for switch operation by engagement with the first limit during actuator movement in one direction and being shifted again relative to the second switch for switch operation by engagement with the second limit during actuator movement in the other direction, the switches being so positioned relative to the cams that upon movement of the actuator in either direction the cams operate their respective switches in the same order.

4. A switch assembly having two switches alternately operated by a reciprocable actuator comprising a switch housing including an elongated guideway integral with the interior of the housing, a circuit board cooperating with the housing to define a switch cavity, first and second cam operated switches in the switch cavity, each switch being actuable between open and closed states, each switch comprising a leaf spring contact secured at one end to the circuit board and having a free end serving as a movable contact, a stationary contact secured to the circuit board for engagement by the free end, and a cam for engaging the leaf spring contact to operate the switch, a reciprocable actuator in the switch cavity and slidably guided by the guideway for sequentially changing the state of the first switch and then the state of the second switch upon movement in one direction and for sequentially changing the state of the first switch and then the state of the second switch upon movement in the return direction, and the actuator having a first cam fixed thereto for movement therewith for operating the first switch and a second cam for operating the second switch, an elongated slot in the actuator extending parallel to the direction of actuator reciprocation, the second cam slidably supported by the actuator in the slot between first and second limits defined by the slot so as to form a lost motion connection between the actuator and the second cam, the second cam being shifted relative to the second switch for switch operation by engagement with the first limit during actuator movement in one direction and being shifted again relative to the second switch for switch operation by engagement with the second limit during actuator movement in the other direction, the second cam being biased against the housing by its respective leaf spring contact to frictionally hold the second cam from movement during lost motion action of the actuator during at least one direction of actuator movement, the switches being so positioned relative to the cams that upon movement of the actuator in either direction the cams operate their respective switches in the same order.

* * * * *